US010658758B2

(12) United States Patent
Hafenrichter et al.

(10) Patent No.: US 10,658,758 B2
(45) Date of Patent: May 19, 2020

(54) MODULAR ANTENNA ASSEMBLY

(71) Applicant: THE BOEING COMPANY, Chicago, IL (US)

(72) Inventors: Joseph L. Hafenrichter, Seattle, WA (US); Manny S. Urcia, Bellevue, WA (US); Joseph A. Marshall, Kent, WA (US); Charles W. Manry, Jr., Auburn, WA (US); Mohammad-Nasar M. Adeeyo, Seattle, WA (US)

(73) Assignee: The Boeing Company, Chicago, IL (US)

( * ) Notice: Subject to any disclaimer, the term of this patent is extended or adjusted under 35 U.S.C. 154(b) by 1338 days.

(21) Appl. No.: 14/254,955

(22) Filed: Apr. 17, 2014

(65) Prior Publication Data

US 2015/0303586 A1 Oct. 22, 2015

(51) Int. Cl.

| | |
|---|---|
| ***H01Q 21/06*** | (2006.01) |
| ***H01Q 21/00*** | (2006.01) |
| ***H01Q 1/40*** | (2006.01) |

(52) U.S. Cl.

CPC ..... *H01Q 21/0025* (2013.01); *H01Q 1/40* (2013.01); *H01Q 21/0087* (2013.01); *H01Q 21/061* (2013.01)

(58) Field of Classification Search

CPC .... H01Q 1/40; H01Q 21/0025; H01Q 21/061; H01Q 21/0087

USPC ..... 343/893, 873

See application file for complete search history.

(56) References Cited

U.S. PATENT DOCUMENTS 4,885,589 A * 12/1989 Edward ..... G01S 7/003 342/175
5,132,648 A * 7/1992 Trinh ..... H01P 5/12 333/128
5,293,171 A 3/1994 Cherrette
5,666,128 A * 9/1997 Murray ..... H01Q 1/288 343/705

(Continued)

FOREIGN PATENT DOCUMENTS

EP 2120283 A1 * 11/2009 ..... H01Q 1/02
JP 60010806 1/1985

(Continued)

OTHER PUBLICATIONS

Notification of Transmittal of the International Search Report and the Written Opinion of the International Searching Auhority for PCT/US2015/011644, dated Oct. 9, 2015.

(Continued)

*Primary Examiner* — Jessica Han
*Assistant Examiner* — Bamidele A Jegede
(74) *Attorney, Agent, or Firm* — The Small Patent Law Group LLC; Joseph M. Butscher

(57) ABSTRACT

Embodiments of the present disclosure provide an antenna assembly that includes a plurality of separate and distinct antenna modules that are interconnected together to form an antenna layer. Each of the antenna modules may include a support structure including a core frame connected to a core support, and a backskin connected to one or both of the core frame and the core support. The antenna assembly may also include an alignment grid configured to receive and align each of the antenna modules, and/or a matching layer configured to receive and align each of the antenna modules.

18 Claims, 10 Drawing Sheets

(56) References Cited

U.S. PATENT DOCUMENTS 5,724,048 A * 3/1998 Remondiere ..... H01Q 1/288 343/700 MS
6,078,289 A * 6/2000 Manoogian ..... H01Q 21/0025 342/373
6,166,705 A * 12/2000 Mast ..... H01Q 1/38 342/372
6,323,809 B1 11/2001 Maloney
6,333,712 B1 12/2001 Haugse
6,512,487 B1 1/2003 Taylor
6,624,787 B2 * 9/2003 Puzella ..... H01Q 9/0407 343/700 MS
6,670,930 B2 * 12/2003 Navarro ..... H01Q 21/0087 343/700 MS
6,947,008 B2 * 9/2005 Tillery ..... H01Q 1/085 343/824
7,046,209 B1 5/2006 McCarville
7,109,942 B2 9/2006 McCarville
7,109,943 B2 9/2006 McCarville
7,113,142 B2 9/2006 McCarville
7,265,719 B1 * 9/2007 Moosbrugger .... H01Q 21/0025 343/700 MS
7,348,932 B1 * 3/2008 Puzella ..... H01Q 21/0025 342/373
7,372,420 B1 * 5/2008 Osterhues ..... H01Q 21/0087 343/776
7,859,835 B2 * 12/2010 Puzella ..... H01Q 1/02 343/853
8,446,330 B1 5/2013 McCarville
8,643,554 B1 2/2014 Manry
2001/0046258 A1 * 11/2001 Wise ..... H01Q 1/084 375/219
2003/0074781 A1 * 4/2003 Roy ..... H01F 27/263 29/602.1
2004/0150561 A1 * 8/2004 Tillery ..... H01Q 1/085 343/700 MS
2004/0262645 A1 * 12/2004 Huff ..... B81B 7/0064 257/232
2005/0110681 A1 * 5/2005 Londre ..... H01Q 1/246 343/700 MS
2006/0097947 A1 5/2006 McCarville
2007/0027353 A1 11/2007 Yang
2008/0074324 A1 * 3/2008 Puzella ..... H01Q 21/0025 343/700 MS
2008/0150799 A1 * 6/2008 Hemmi ..... H01Q 13/085 342/361
2009/0135085 A1 * 5/2009 Raby ..... H01Q 3/26 343/906
2010/0053026 A1 * 3/2010 Van Der Poel ..... H01Q 1/523 343/908
2010/0066631 A1 * 3/2010 Puzella ..... H01Q 21/0025 343/853
2010/0177011 A1 7/2010 Sego
2010/0177012 A1 * 7/2010 Morrow ..... H01Q 21/0025 343/893
2010/0246130 A1 * 9/2010 Paquette ..... E05D 3/022 361/704
2013/0229321 A1 * 9/2013 McCarville ..... H01Q 21/26 343/798

FOREIGN PATENT DOCUMENTS

JP 2001-007628 1/2001
JP 2001-119229 4/2001
JP 2012-129943 5/2012
JP 2012-109670 6/2012

OTHER PUBLICATIONS

"A Low-Profile Broadband Phased Array Antenna," Munk, et al., IEEE (2003).
"Ultra-Wideband Arrays," Dover, et al., IEEE (2003).
"Electrical Behavior of Phase-Change Memory Cells Based on GeTe," Perniola, et al. IEEE Electron Device Letters, vol. 31, No. 5, (May 2010).
"On the Gain of a Reconfigurable-Aperture Antenna," Brown, IEEE Transactions on Antennas and Propagation, vol. 49, No. 10 (Oct. 2001).
"GTRI Reconfigurable Aperture Design," Pringle, et al., IEEE (2002).
"Non-Foster and connected planar arrays," Hansen, Radio Science, vol. 39, RS4004 (2004).
"A New Approach to Broadband Array Design Using Tightly Coupled Elements," Jones, et al., IEEE (2007).
"The Planar Ultrawideband Modular Antenna (PUMA) Array," Holland, IEEE Transactions on Antennas and Propagation, vol. 60, No. 1 (Jan. 2012).
"A Reconfigurable Aperture Antenna Based on Switched Links Between Electrically Small Metallic Patches," Pringle, et al., IEEE Transactions on Antennas and Propagation, vol. 52, No. 6 (Jun. 2004).
"Scan Blindness in Infinite Phased Arrays of Printed Dipoles," Pozar, IEEE Transactions on Antennas and Propagation, vol. AP-32, No. 6 (Jun. 1984).
"Vivaldi Antenna Arrays for Wide Bandwidth and Electronic Scanning," Schaubert, et al., IEEE (downloaded 2010).
"Simple Relations Derived from a Phased-Array Antenna Made of an Infinite Current Sheet," Wheeler, IEEE Transactions on Antennas and Propagation (Jul. 1965).
"A New Class of Antenna Array with a Reconfigurable Element Factor," Zhouyuan, et al., IEEE Transactions on Antennas and Propagation, vol. 61, No. 4 (Apr. 2013).
Communication re EP 15745261.6-1206, dated Feb. 18, 2019.
Notice of Reasons for Rejection re JP 2016-562927, dated Feb. 26, 2019 (and English translation).
Notice of Reasons for Rejection for JP application 2016-562927, dated Oct. 29, 2019 (and English translation).

* cited by examiner

MODULAR ANTENNA ASSEMBLY

BACKGROUND OF THE DISCLOSURE

Embodiments of the present disclosure generally relate to antenna assemblies, and, more particularly, to antenna assemblies including antenna modules that connect together to form an antenna layer.

Microwave antennas may be used in various applications, such as satellite reception, remote sensing, military communication, and the like. Printed circuit antennas generally provide low-cost, light-weight, low-profile structures that are relatively easy to mass produce. These antennas may be designed in arrays and used for radio frequency systems, such as identification of friend/foe (IFF) systems, electronic warfare systems, radar, signals intelligence systems, personal communication systems, satellite communication systems, and the like.

Typically, an antenna assembly is formed as a single unit. For example, an entire assembly may be formed as a single, integral piece. As such, if the antenna assembly exhibits any imperfections or defects, the entire antenna assembly is typically defective and unusable. In general, the probability of imperfections and defects in an antenna assembly increases with larger antenna assembly sizes.

Current methods of manufacturing an antenna assembly combine large, complex components into a single antenna assembly. Aligning the large, complex components into a bondable configuration is typically labor and time intensive. Complex and/or expensive tooling is typically used to form a single antenna assembly. Moreover, well-trained, skilled labor is needed to form the antenna assembly.

Additionally, current methods of manufacture generally do not allow components of the assembly to be tested prior to bonding to ensure proper operation. Instead, all components are bonded together simultaneously, despite the possibility of certain defects occurring during the bonding process.

In general, systems and methods for manufacturing typical antenna assemblies lack scalability. Additionally, known systems and methods are time and labor intensive.

SUMMARY OF THE DISCLOSURE

Certain embodiments of the present disclosure provide an antenna assembly that may include a plurality of separate and distinct antenna modules that are interconnected together to form an antenna layer. In at least one embodiment, the antenna assembly may also include an alignment grid configured to receive and align each of the antenna modules. Additionally, or alternatively, the antenna assembly may also include a matching layer configured to receive and align each of the antenna modules.

The antenna assembly may also include an electronics layer operatively connected to the antenna layer. The electronics layer may include a plurality of separate and distinct electronics card modules. That is, the electronics layer may be formed by a plurality of interconnected electronics card modules.

Each antenna module may include a support structure. The support structure may include a core frame connected to a core support. In at least one embodiment, the core frame is separate and distinct from the core support.

Each antenna module may include a backskin connected to one or both of the core frame and the core support. The backskin may include reciprocal holes that receive and retain connection members, such as posts, tabs, or the like, that extend from the core frame and/or the core support.

Each antenna module may include one or more antenna elements. For example, each antenna module may include an antenna card, which may be formed of a circuit board, which supports a plurality of antenna elements above, or below, or within the antenna card.

Each antenna module may be bonded together with adhesive through rotational curing. For example, the structural components of the antenna module may be mechanically connected together, covered with a flowing adhesive, such as a resin, and rotated during a heating or curing process to decrease the viscosity of the adhesive so that it may easily flow over and through the connection interfaces and interstices. The rotational movement ensures that the adhesive is distributed over and through the connection interfaces and interstices, while excess adhesive drains off surfaces through gravity. After the adhesive adequately coats the antenna module, the heating may stop so that the adhesive may harden and securely bond the components together.

Notably, the antenna modules are bonded before being connected together to form the antenna assembly. As such, each antenna module may be tested and checked prior to being included in a final antenna assembly.

In at least one embodiment, each antenna module may include a half-thickness outer wall that combines to form a full thickness outer wall when abutting against another half-thickness wall of another one of the plurality of separate and distinct antenna modules.

DETAILED DESCRIPTION OF THE DISCLOSURE

The foregoing summary, as well as the following detailed description of certain embodiments will be better understood when read in conjunction with the appended drawings. As used herein, an element or step recited in the singular and proceeded with the word "a" or "an" should be understood as not excluding plural of the elements or steps, unless such exclusion is explicitly stated. Further, references to "one embodiment" are not intended to be interpreted as excluding the existence of additional embodiments that also incorporate the recited features. Moreover, unless explicitly stated to the contrary, embodiments "comprising" or "having" an element or a plurality of elements having a particular property may include additional elements not having that property.

Figure 1:
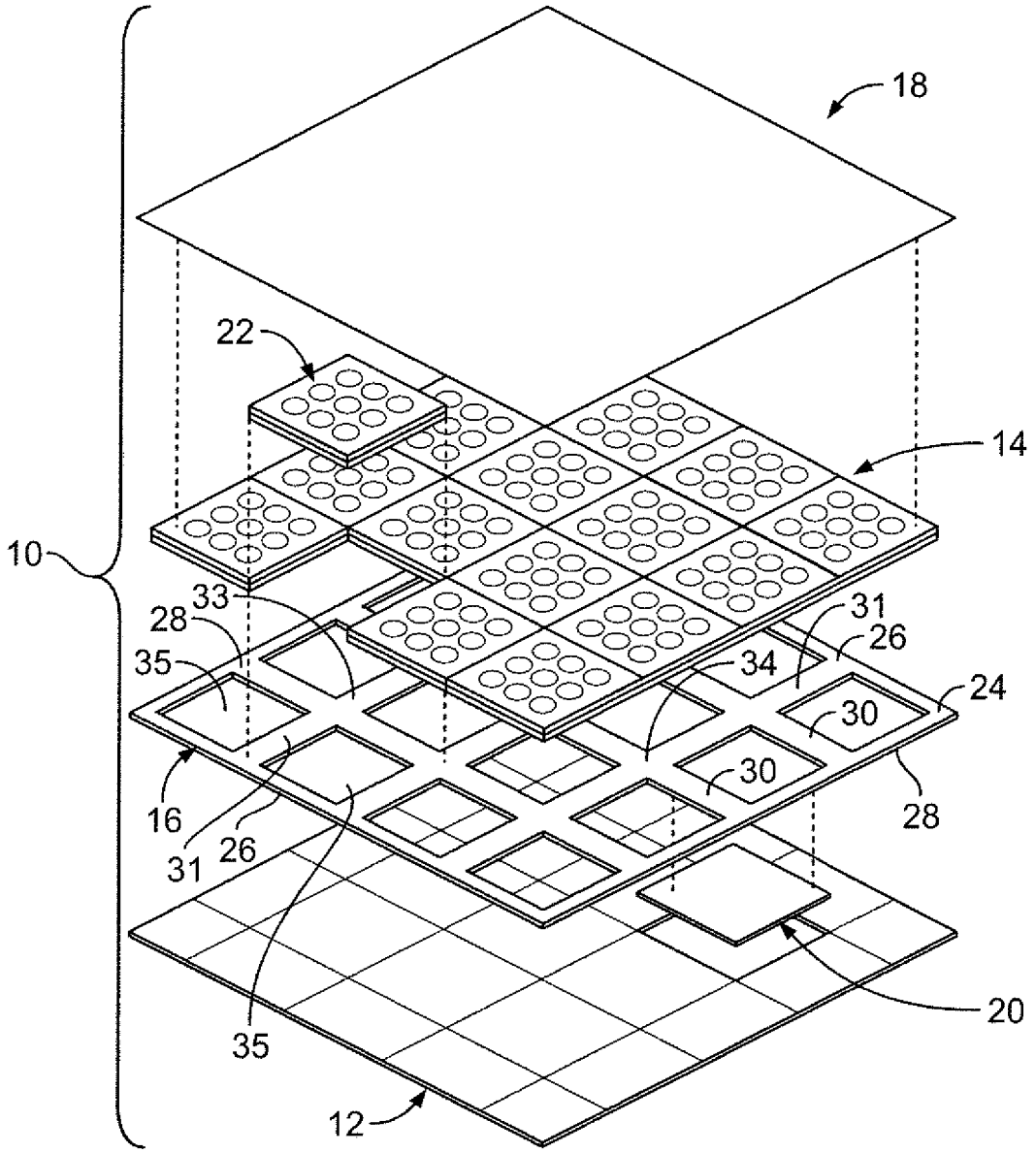
FIG. 1 illustrates a perspective top exploded view of an antenna assembly, according to an embodiment of the present disclosure.

FIG. 1 illustrates a perspective top exploded view of an antenna assembly 10, according to an embodiment of the present disclosure. The antenna assembly may include an electronics layer 12 that may connect to an antenna array or layer 14 through an alignment grid 16. A cover layer 18 may be positioned over the antenna layer 14.

The electronics layer 12 may include a plurality of electronics card modules 20 that modularly interconnect to form the electronics layers 12. The electronics layer 12 provides backend electronics for the antenna assembly 10 that may be used to control and otherwise operate the antenna assembly 10. Alternatively, the electronics layer 12 may be formed as a single, unitary piece.

The antenna layer 14 includes a plurality of separate and distinct antenna modules 22, such as antenna array cells, units, or the like, that interconnect to form the antenna layer 14. Each antenna module 22 may be separately formed. For example, each antenna module 22 may include components that are bonded together. After the bonding, the antenna module 22 may be tested and checked. As such, each antenna module 22 may be tested, or checked before being used to form the antenna assembly 10.

The antenna modules 22 may be supported by the alignment grid 16, which may be used to support, locate, align, and register the antenna modules 22 with respect to the electronics layer 12. The alignment grid 16 may include a planar frame 24 including outer parallel ends 26 integrally connected to outer parallel sides 28, which may be orthogonal to the ends 26. Cross beams 30 extend between the sides 28, while cross beams 31 extend between the ends 26, thereby providing intersections 33 and defining connection channels 35. Bottom surfaces of each antenna module 22 are configured to extend into the connection channels 35 to mechanically and electronically connect with upper surfaces of counterpart electronics card modules 20. For example, the antenna modules 22 may include tapered bottom surfaces that extend into the connection channels 35, while the electronics card modules 20 include reciprocal top surfaces that extend into the connection channels 35. In this manner, the alignment grid 16 may be used to align, register, and connect the antenna layer 14 to the electronics layer 12, while also supporting the weight of the antenna layer 14. Alternatively, the antenna assembly 10 may not include the alignment grid 16. Instead, the antenna modules 22 may be directly aligned and connected onto the electronics layer 12 without the use of the alignment grid 16.

The cover layer 18 is configured to provide a top covering skin portion for the antenna assembly 10. The cover layer 18 may be or include a radome, for example, which may be formed of a dielectric material. The cover layer provides a structural, weatherproof enclosure that protects the antenna layer 14, and may be formed of material that minimally attenuates the electromagnetic signal transmitted or received by the antenna layer 14. As shown, the cover layer 18 may be formed as a planar sheet. However, the cover layer 18 may be various other shapes and sizes, such as a block, pyramid, sphere, or the like. Alternatively, the antenna assembly 10 may not include the cover layer 18.

Figure 2:
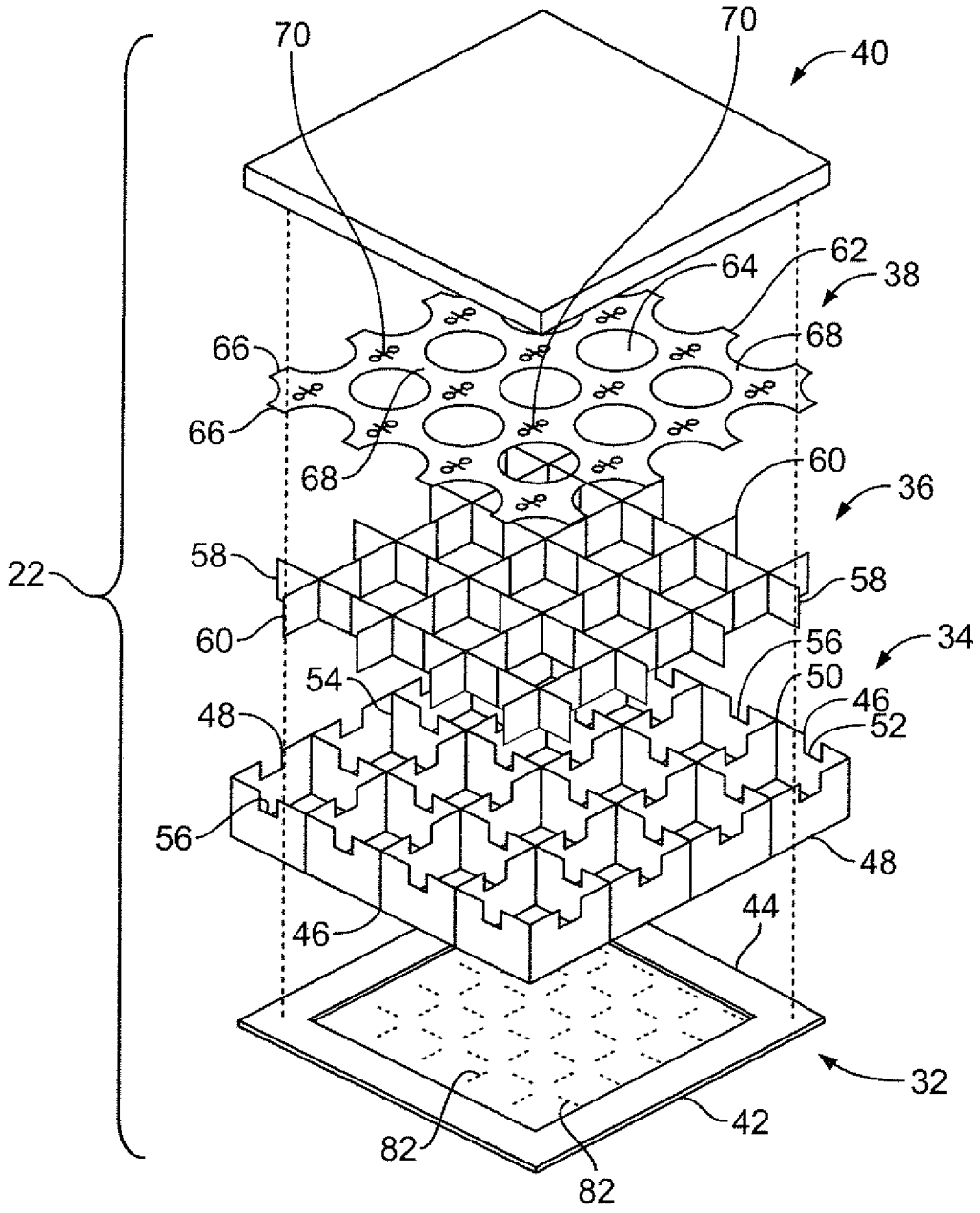
FIG. 2 illustrates a perspective top exploded view of an antenna module, according to an embodiment of the present disclosure.

FIG. 2 illustrates a perspective top exploded view of an antenna module 22, according to an embodiment of the present disclosure. The antenna module 22 may include a planar backskin or interface 32 that supports a structural core or core frame 34. An aperture core or internal core support 36 may be secured within or otherwise to the core frame 34. An antenna card 38 may be supported by the core frame 34 and the core support 36. A dielectric layer 40, such as a dielectric matching layer, may be positioned over the antenna card 38. Alternately, the matching layer 40 may be formed using a plurality of low loss materials and layers. Alternately, the antenna module 22 may not include the dielectric matching layer 40.

The backskin 32 may include an outer frame 42 that securely retains an interfacing sheet 44, which may include one or more features that are configured securely mate with reciprocal features of a support structure, such as the core frame 34 and/or the core support 36. The backskin 32 may be configured to connect the antenna module 22 to a counterpart electronics card module 20, for example.

The core frame 34 may include upstanding outer frame end walls 46 that connect to upstanding outer frame side walls 48. Internal support walls 50 connect between the end walls 46, while internal support walls 52 connect between the side walls 48, thereby forming internal passages 54 therebetween. The outer frame end walls 46 and outer frame side walls 48 may be half the thickness of the internal support walls 50 and 52. In this manner, when the antenna module 22 abuts against a neighboring antenna module 22, the half thickness walls combine to form a full thickness wall. Alternatively, the outer frame end walls 46 and the outer frame side walls 48 may be outer support walls, similar to the walls 50 and 52.

As shown, top portions of the end walls 46, side walls 48, and internal support walls 50 and 52 may include recessed areas 56 at regularly spaced intervals about each internal passage 54. The recessed areas 56 may be configured to receive and retain portions of the core support 36 and/or the antenna card 38. The recessed areas 56 may be sized and shaped to accommodate the core support 36 and/or the antenna card 38. Alternatively, the core frame 34 may not include the recessed areas 56. The core frame 34 may be formed of a low-loss dielectric material, such as fiberglass, for example.

The core support 36 may include a first set of parallel walls 58 that connect to orthogonal parallel walls 60. The planar walls 58 and 60 are configured to be received and retained within the core frame 34. The core support 36 may be formed of a low-loss dielectric material, such as fiberglass, for example. As shown, the core frame 34 and the core support 36 are shown as separate and distinct components. Alternatively, the core frame 34 and the core support 36 may be integrally formed as a single piece.

The core frame 34 and the core support 36 may be separate and distinct components to reduce manufacturing costs. The core frame 34 and the core support 36 may include one or more indexing members, such as tabs, slots, and the like. That is, the core frame 34 and the core support may include complimentary alignment and restraining features in order to properly secure together.

The antenna card 38 may include a planar sheet 62 of circuit board material having a plurality of openings 64 formed therethrough. The antenna card 38, which may be formed using a plurality of materials and layers, is configured to be supported over the core frame 34 and the core support 36. For example, the antenna card 38 may include external tabs 66 and internal ribs 68 that are configured to be received and retained by the recessed areas 56 of the core frame 34. A plurality of antenna elements 70 are secured over, under, and/or within the planar sheet 62.

As explained below, the backskin 32, the core frame 34, the core support 36, and the antenna card 38 may be bonded together to form a formed antenna module 22.

Figure 3:
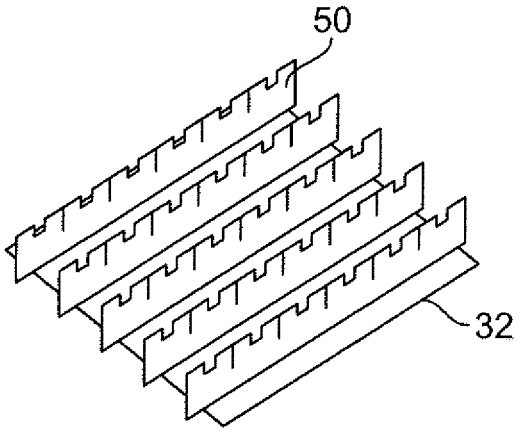
FIG. 3 illustrates a perspective top view of upright support walls mounted on a backskin, according to an embodiment of the present disclosure.

FIG. 3 illustrates a perspective top view of upright support walls 50 mounted on the backskin 32, according to an embodiment of the present disclosure. In order to form an antenna assembly, the upright support walls 50 may first be positioned over the backskin 32 in an upright fashion.

Figure 4:
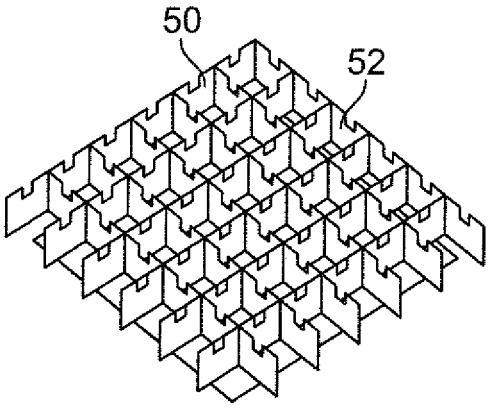
FIG. 4 illustrates a perspective top view of upright support walls mounted on a backskin and connected to orthogonal upright support walls, according to an embodiment of the present disclosure.

FIG. 4 illustrates a perspective top view of the upright support walls 50 mounted on the backskin 32 and connected to orthogonal upright support walls 52, according to an embodiment of the present disclosure. The upright support walls 52 may connect to the upright support walls 50 through tabs, slots, grooves, tongue and groove connections, or the like. The upright support walls 50 and 52 cooperate to form the core frame 34, as shown in FIG. 2.

Figure 5:
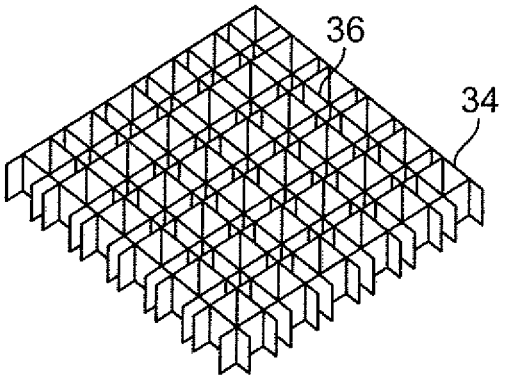
FIG. 5 illustrates a perspective top view of a core support secured to a core frame over a backskin, according to an embodiment of the present disclosure.

FIG. 5 illustrates a perspective top view of the core support 36 secured to the core frame 34 over the backskin 32 (hidden from view in FIG. 5), according to an embodiment of the present disclosure. The core support 36 may fit into reciprocal channels formed through the core frame 34. The core support 36 and the core frame 34 cooperate to provide a structural support for the antenna card 38.

Figure 6:
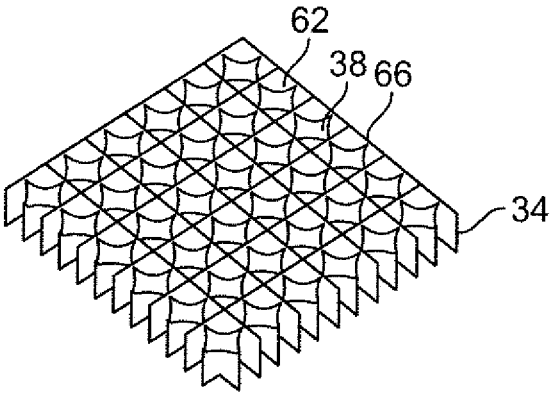
FIG. 6 illustrates a perspective top view of an antenna card secured to a core support and core frame, according to an embodiment of the present disclosure.

FIG. 6 illustrates a perspective top view of the antenna card 38 secured to the structural support defined by the core support 36 and the core frame 34, according to an embodiment of the present disclosure. As shown, the planar sheet may rest over upper edges of the core support 36, while external tabs 66 are retained within recessed areas 56 of the core frame 34.

Referring to FIGS. 1-6, the antenna module 22 may include more or less components than shown. For example, the antenna module 22 may include the antenna card 38 mounted directly to the backskin 32 without the structural support that includes the core frame 34 and the core support 36. Also, alternatively, the core frame 34 and the core support 36 may include more or less upright walls than shown. Further, the core frame 34 and the core support 36 may connect together through various structural interfaces other than tabs and slots, and the like. Further, as noted above, the core frame 34 and the core support 36 may be integrally molded and formed as a single unitary piece. Also, the antenna module 22 may be various shapes and sizes, and include more or less antenna elements than shown.

Figure 7:
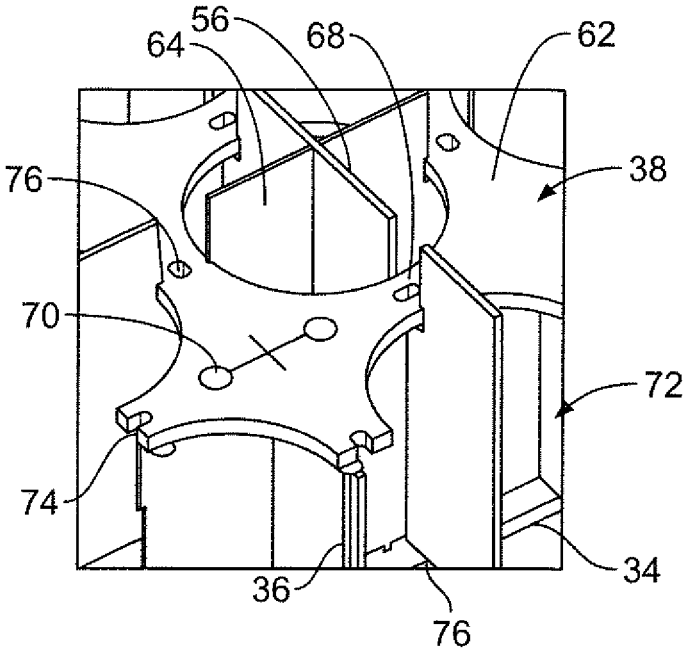
FIG. 7 illustrates a perspective top view of an antenna card secured to a support structure, according to an embodiment of the present disclosure.

FIG. 7 illustrates a perspective top view of the antenna card 38 secured to the support structure 72, which may include the core frame 34 and the core support 36, according to an embodiment of the present disclosure. As shown, the internal ribs 68 of the antenna card 38 are received and retained within the recessed areas 56 of the core frame 34. The recessed areas 56 are sized and shaped to retain the ribs 68 (and the external tabs 66, which are not shown in FIG. 7). The planar sheet 62 may include a plurality of slots 74 that are configured to securely mate with upwardly extending tabs 76 of the core support 36. Alternatively, the planar sheet 62 may include downwardly extending tabs that fit into slots formed through upper portions of the core support 36.

Figure 8:
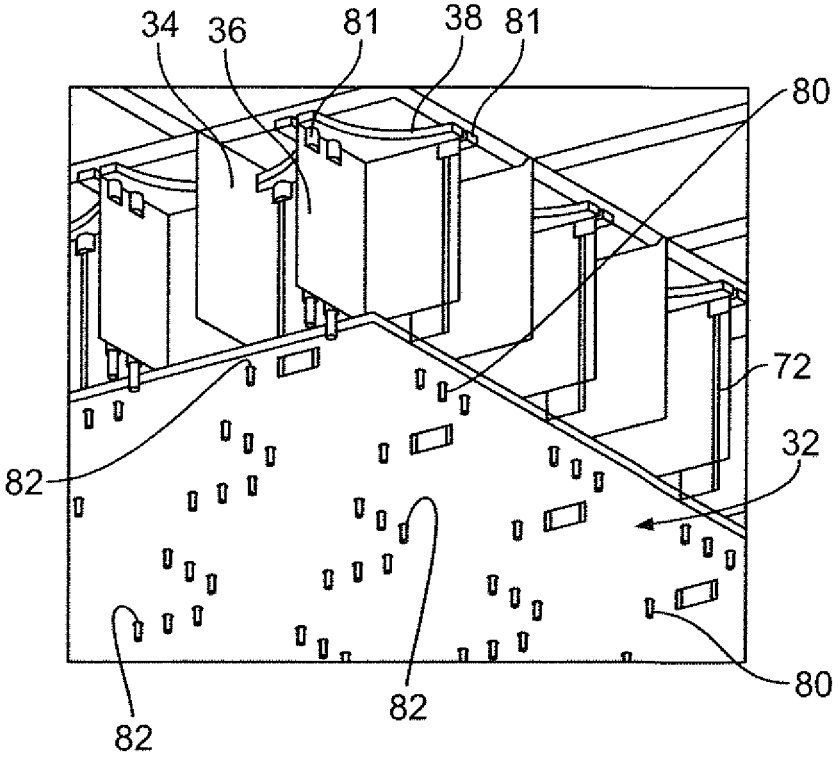
FIG. 8 illustrates a perspective bottom view of an antenna module, according to an embodiment of the present disclosure.

FIG. 8 illustrates a perspective bottom view of the antenna module 22, according to an embodiment of the present disclosure. The support structure 72 may include a plurality of connection members, such as downwardly-extending posts 80. For example, the core frame 34 and/or the core support 36 may include the posts 80 at various locations. The posts 80 are configured to be retained within reciprocal openings 82 formed through the backskin 32, in order to securely locate and retain the support structure 72 to the backskin 32. The posts may be conductive to provide electrical connection between the antenna module 22 and a counterpart electronics card module. Elastomeric contact sleeves 81 may be used to provide a reliable connection between the core support 36 (and/or the core frame 34) and conductive leads (not shown) that extend to the antenna card 38.

Referring to FIGS. 2-8, after the components of the antenna module 22 are structurally connected together, the components may be bonded together. For example, the antenna module 22 may be positioned within a receptacle (such as a pan, basin, or the like) and a resin or other such adhesive may be poured over the antenna module 22. Heat may be applied in a curing process to reduce the viscosity of the adhesive so that it may flow over and through the antenna module 22. The adhesive may pass between all interfaces and interstices of the antenna module 22, thereby coating the antenna module 22 with the adhesive. During the heating or curing process, the antenna module 22 may be rotated (such as at a constant angular velocity) in order to evenly distribute the adhesive throughout the antenna module 22, and minimize or otherwise reduce any pooling of the adhesive on non-connecting surfaces.

Because the antenna modules 22 are smaller than a fully formed antenna assembly, the antenna modules 22 may be safely and easily vertically cured through a rotisserie-like rotation. In contrast, a previous full, layered antenna assembly may be susceptible to damage through such a rotational curing process. In short, each antenna module 22 may be covered with a liquid adhesive, and rotated during a curing process to distribute the adhesive through the interstices and interfaces thereof, while allowing adhesive on flat planar surfaces to drain off through gravity. Once the adhesive is desirably coated over the connecting interfaces and interstices, the curing or heating process may stop, so that the adhesive may harden and bond the components together.

During rotation of the antenna module 22, the adhesive may accumulate in interstices, spaces, fillets, and the like of the antenna module due to surface tension effects, while excess adhesive may drain from the antenna module 22 through gravity. In this manner, the bonding of the components of the antenna module 22 is strengthened in that additional adhesive, such as a resin, within the interstices, spaces, fillets, and the like increases the adhesive connection. At the same time, adhesive that may be on flat surfaces of the antenna module 22 drains off of the antenna module 22 during rotation. The rotation is continued during the curing process. After the rotation is complete, the curing may stop so that the adhesive may harden and bond the components of the antenna module 22 together.

As described above, the antenna module 22 may be bonded together with adhesive through rotational curing. For example, the structural components of the antenna module 22 may be mechanically connected together, covered with a flowing adhesive, such as a resin, and rotated during a heating or curing process to decrease the viscosity of the adhesive so that the adhesive may easily flow over and through the connection interfaces and interstices. The rotational movement ensures that the adhesive is distributed over and through the connection interfaces and interstices, while excess adhesive drains off flat surfaces through gravity. After the adhesive adequately coats the antenna module 22, the heating or curing may stop so that the adhesive may harden and securely bond the components together.

After the antenna module 22 has been formed and bonded together, the antenna module 22 may be modularly connected to other antenna modules 22 to form the antenna layer 14, shown in FIG. 1, for example. Before each antenna module 22 is used to form a fully-formed antenna assembly, each antenna module 22 may be separately quality-tested and checked.

Figure 9:
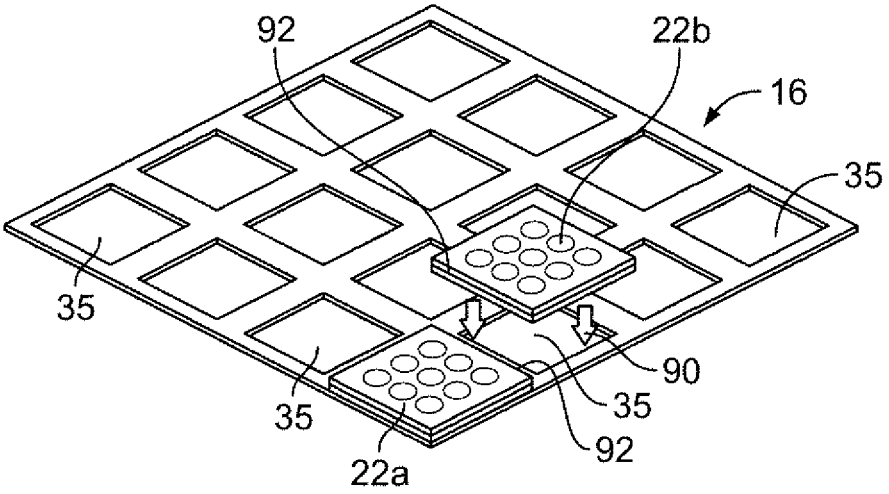
FIG. 9 illustrates a perspective top view of antenna modules being connected together on an alignment grid, according to an embodiment of the present disclosure.

FIG. 9 illustrates a perspective top view of antenna modules 22*a* and 22*b* being connected together on the alignment grid 16, according to an embodiment of the present disclosure. The antenna module 22*a* is positioned on the alignment grid 16 with respect to a first connection channel 35. Adhesive may be deposited or otherwise placed on mating surfaces of the alignment grid 16 that connect to reciprocal surfaces of the antenna modules 22*a* and 22*b*. The antenna module 22*b* is aligned within a second, neighboring connection channel 35 and urged therein in the direction of arrow 90. Once positioned within the neighboring connection channel 35, the antenna module 22*b* abuts into the antenna module 22*a* to form a contiguous portion of the antenna layer 14 (shown in FIG. 1). Outer wall portions 92 (such as half thickness outer frame walls) of the antenna modules 22*a* and 22*b* may be coated with an adhesive, such as epoxy, to securely connect the antenna modules 22*a* and 22*b* together. Optionally, outer wall portions 92 of the antenna modules 22*a* and 22*b* may include various mechanical features, such as groove, tabs, slots, barbs, claps, latches, or the like, that mechanically secure the antenna modules 22*a* and 22*b* together. Additional antenna modules 22 may be secured to the antenna modules 22*a* and 22*b* to form the antenna layer 14. More or less antenna modules 22 than shown in FIG. 1 may be used to form the antenna layer 14. Additionally, while shown having a square axial cross-section, the antenna modules 22 may alternatively be formed of various other shapes and sizes, such as circles, hexagons, octagons, trapezoids, and the like.

Figure 10:
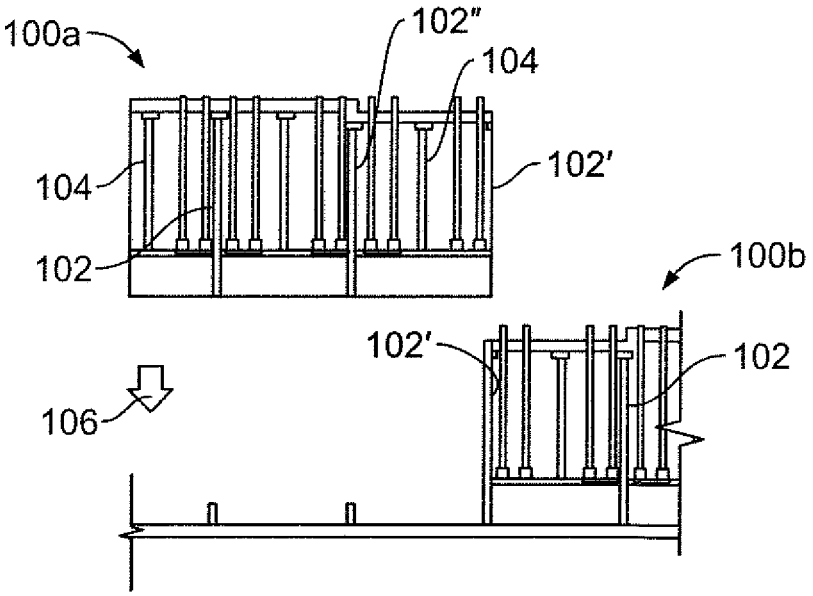
FIG. 10 illustrates a transverse cross-sectional view of a first antenna module being positioned with respect to a second antenna module, according to an embodiment of the present disclosure.

FIG. 10 illustrates a transverse cross-sectional view of a first antenna module 100*a* being positioned with respect to a second antenna module 100*b*, according to an embodiment of the present disclosure. The antenna modules 100*a* and 100*b* may be examples of the antenna modules 22, described above. The antenna module 100*a* is moved down in the direction of arrow 106 to connect to the antenna module 100*b*.

As shown, each antenna module 100*a* and 100*b* may include core frame walls 102 (such as of a core frame 34, for example) and support walls 104 (which may be, for example, core support walls of a core support 36, for example). Outer core frame walls 102' may be half the thickness of the internal core frame walls 102". In this manner, when the antenna module 100*a* connects to the antenna module 100*b*, the half thickness outer core frame walls 102' connect to form a full thickness core frame wall. As noted above, the outer core frame walls 102' may be coated with adhesive to securely connect together.

Figure 11:
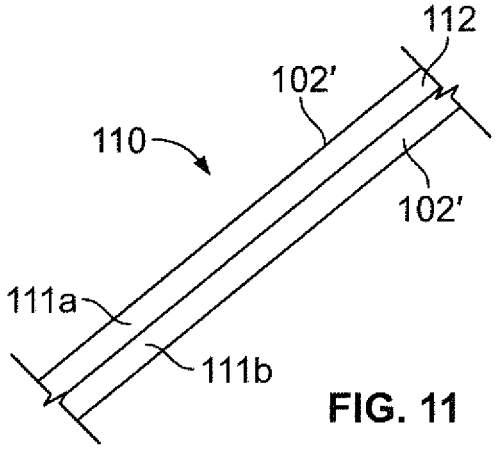
FIG. 11 illustrates a top plan view of a connection joint between two antenna modules, according to an embodiment of the present disclosure.

FIG. 11 illustrates a top plan view of a connection joint 110 between two antenna modules 111*a* and 111*b*, according to an embodiment of the present disclosure. As shown, the half thickness walls 102' of abutting antenna modules 111*a* and 111*b* may abut into one another and be bonded together with a paste adhesive 112, such as an epoxy, to form a lap joint therebetween. The paste adhesive 112 may provide a shim and a bonding agent.

Figure 12:
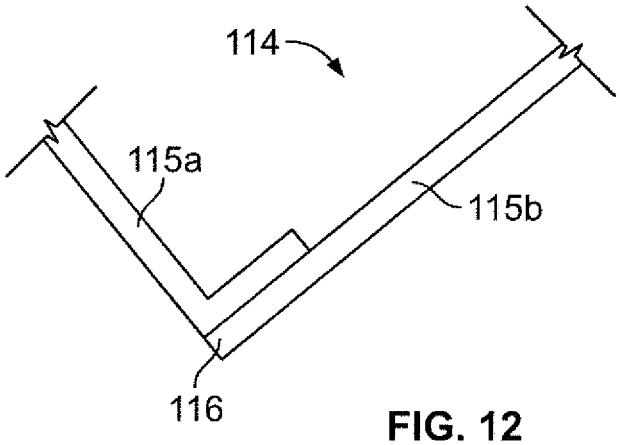
FIG. 12 illustrates a top plan view of a connection joint between two antenna modules, according to an embodiment of the present disclosure.

FIG. 12 illustrates a top plan view of a connection joint 114 between two antenna modules 115*a* and 115*b*, according to an embodiment of the present disclosure. An L-joint 116 may be used to connect to the modules 115*a* and 115*b* together. A paste adhesive may be used to bond the modules 115*a* and 115*b* together. The L-joint 116 may be an integral part of an outer wall of a module 115*a* or 115*b*, or may alternatively be a separate and distinct piece that connects to the wall portions together.

Figure 13:
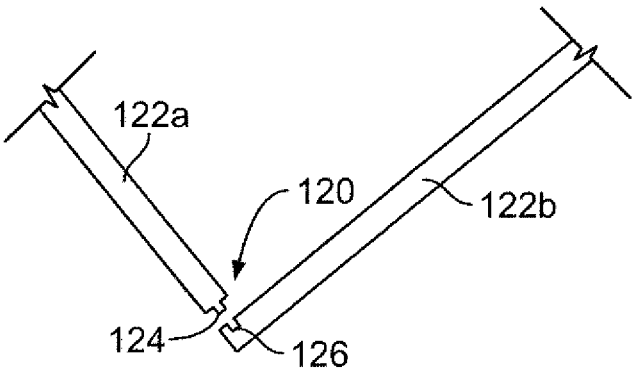
FIG. 13 illustrates a top plan view of a connection joint between two antenna modules, according to an embodiment of the present disclosure.

FIG. 13 illustrates a top plan view of a connection joint 120 between two antenna modules 122*a* and 122*b*, according to an embodiment of the present disclosure. In this embodiment, a wall portion of the antenna module 122*a* may include a tab 124 that fits into a reciprocal slot 126 of a wall portion of the antenna module 122*b*.

Referring to FIGS. 10-13, various connection interfaces, joints, adhesives, and the like may be used to securely connect outer wall portions of neighboring antenna modules together. For example, flanged joint, tab and slot, tongue and groove, interlocking, and other such interfaces may be used. Further, adhesive may also be used with respect to the interfaces to securely connect the antenna modules together. The adhesive may be applied over an entire outer surface of outer walls of the modules. Alternatively, adhesive may be applied to portions of the outer walls. For example, the adhesive may be applied at upper edge portions, lower edged portions, distal ends, and/or the like, as opposed to coating an entire outer surface. Further, portions of outer walls of neighboring antenna modules may interlock with one another, and adhesive may be used as a filler and bonding agent with respect to the interlocking features.

Referring again to FIG. 9, after the antenna modules 22 have been secured and connected together on the alignment grid 16, the cover layer 18 (shown in FIG. 1) may be positioned over the formed antenna layer 14.

Figure 14:
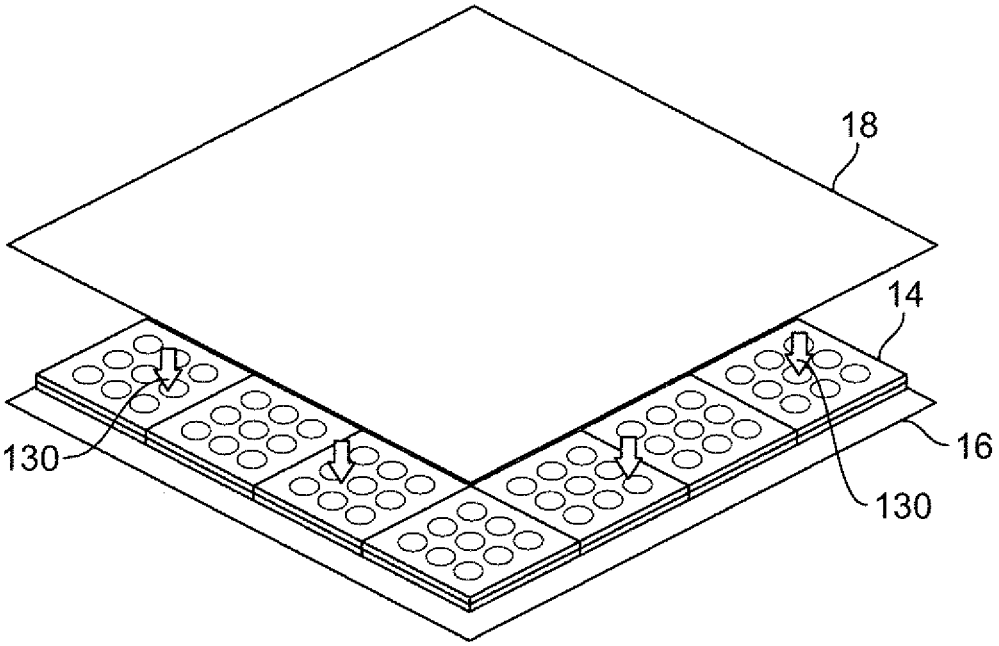
FIG. 14 illustrates a perspective top view of a matching layer being positioned over an antenna layer, according to an embodiment of the present disclosure.

FIG. 14 illustrates a perspective top view of the cover layer 18 being positioned over the antenna layer 14, according to an embodiment of the present disclosure. The cover layer 18 is aligned over the antenna layer 14 and urged downwardly in the direction of arrows 130. Adhesive, such as an epoxy, may be positioned on an underside of the cover layer 18 and/or an upper surface of the antenna layer 14 to securely bond the cover layer 18 to the antenna layer 14.

After the cover layer 18 is secured to the antenna layer 14, the partially-completed assembly may be turned over in order to connect the electronic cards module 20 to the antenna layer 14.

Figure 15:
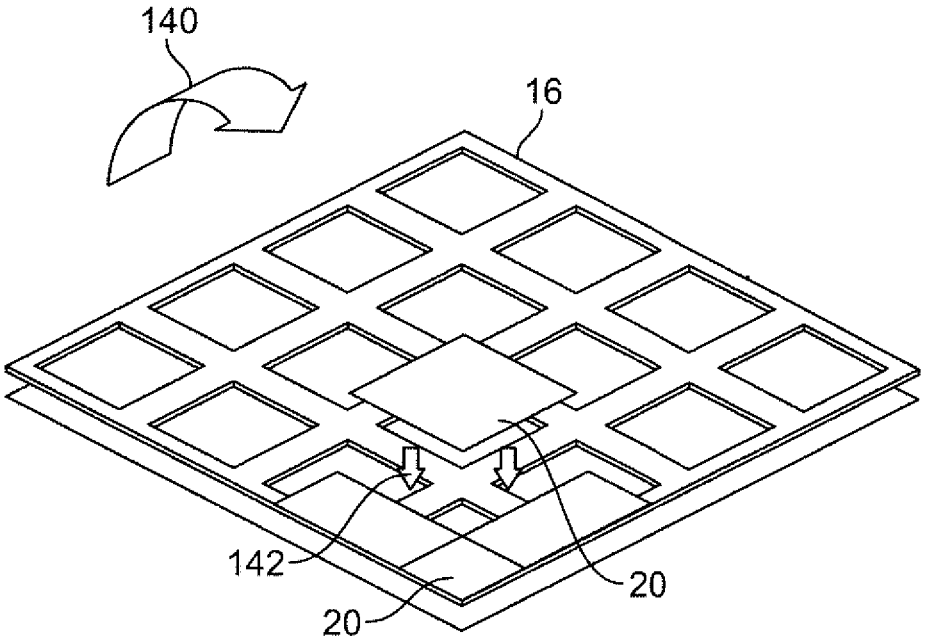
FIG. 15 illustrates a perspective bottom view of electronics card modules being secured to an alignment grid, according to an embodiment of the present disclosure.

FIG. 15 illustrates a perspective bottom view of the electronics card modules 20 being secured to the alignment grid 16, according to an embodiment of the present disclosure. As shown, the partially-completed assembly has been inverted in the direction of arc 140. Each electronics card module 20 is aligned with a respective antenna module that forms the antenna layer 16, and urged in the direction of arrow 142. Adhesive may be applied to connecting interfaces between the electronics card modules 20 and the alignment grid 16 to securely connect the electronics card modules 20 to the alignment grid 16. Additional electronics card modules 20 are added to form a complete electronics layer 12, such as shown in FIG. 1.

Figure 16:
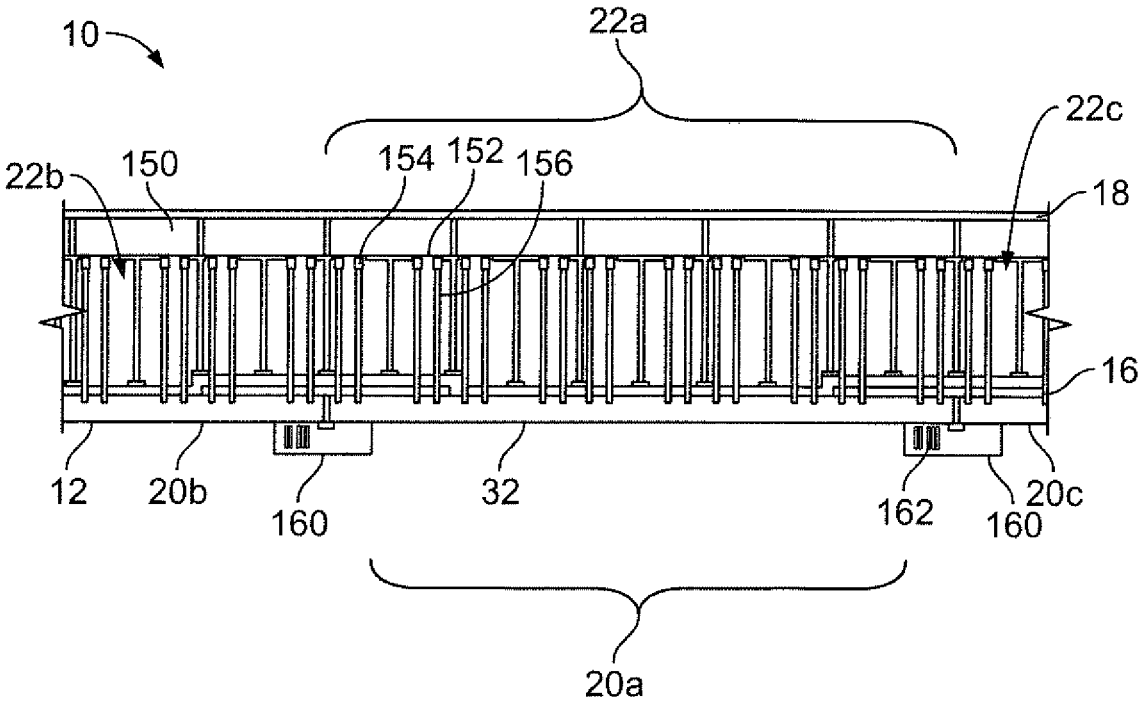
FIG. 16 illustrates a transverse cross-sectional view of an antenna assembly, according to an embodiment of the present disclosure.

FIG. 16 illustrates a transverse cross-sectional view of the antenna assembly 10, according to an embodiment of the present disclosure. The antenna module 22*a* may be connected to the separate and distinct antenna modules 22*b* and 22*c* (and other antenna modules 22) to form the antenna layer 14, as described above. The antenna layer 14 may include more or less antenna modules 22 than shown in FIGS. 1 and 16. A dielectric foam layer and/or a matching layer 150, such as the matching layer 40, may be disposed between the cover layer 18 and the antenna layer 14.

The antenna layer 14 (shown in FIG. 14, for example) may include a plurality of dipole pairs 152 having conductive interconnects 154 connected to conductive leads 156. The dipole pairs 152 may be formed using rectangular shapes, bow-tie shapes, and the like. The electronics layer 12 may include a plurality of electronics card modules 20*a*, 20*b*, and 20*c* that mechanically and/or electronically connect to the antenna modules 22*a*, 22*b*, and 22*c*, respectively in an aligned fashion through the alignment grid 16. Card connectors 160 having card receptacles 162 may be mounted to the electronics layer 12 to provide an electrical connection with other electronic cards (not shown).

The antenna modules 22 may include more or less components than those shown and described. The antenna modules 22 are configured to be combined and connected to one another in a variety of configuration, shapes, sizes, and the like, to form the modular antenna assembly 10. If one of the antenna modules 22 is defective, a different antenna module 22 may be used in its place. As such, the entire antenna assembly 10 need not be discarded. Instead, only an antenna module 22 that is defective, has imperfections, or is otherwise malfunctioning needs to be removed (or not used in the first place).

Figure 17:
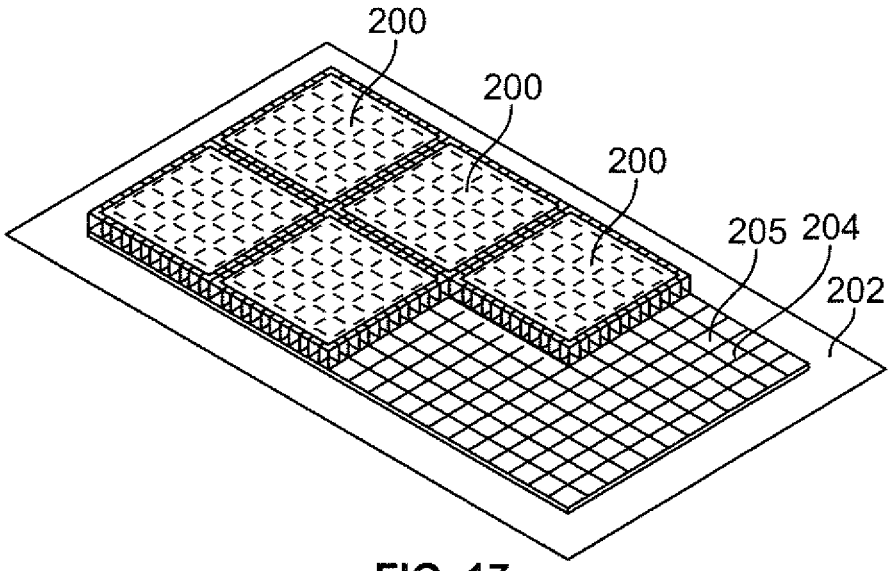
FIG. 17 illustrates a perspective bottom view of antenna modules secured to a matching layer, according to an embodiment of the present disclosure.

FIG. 17 illustrates a perspective bottom view of antenna modules 200 secured to a matching layer 202, according to an embodiment of the present disclosure. Upper surfaces of the antenna modules 200, such as any of those described above, may be aligned with and urged into lower surfaces 204 of the matching layer 202. The lower surfaces 204 may include indexed alignment channels 205 that are configured to receive and retain a reciprocal outer indexing feature (such as wall edges) of the antenna modules 200. As shown, the antenna modules 200 are connected together to form an antenna layer having eight antenna modules 200. However, the antenna layer may include more or less than eight antenna modules 200.

Figure 18:
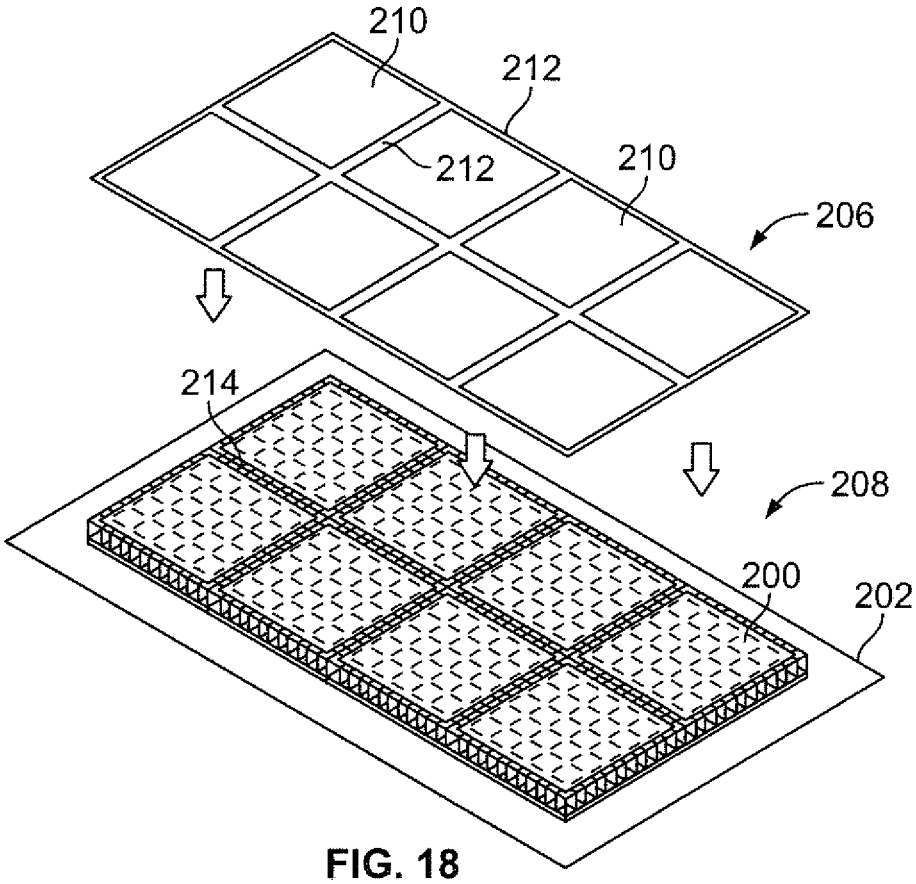
FIG. 18 illustrates a perspective bottom view of an alignment grid being secured over an antenna layer, according to an embodiment of the present disclosure.

FIG. 18 illustrates a perspective bottom view of an alignment grid 206 being secured over an antenna layer 208 formed from eight antenna modules 200, according to an embodiment of the present disclosure. The alignment grid 206 is aligned with the antenna layer 208 so that each connection channel 210 is aligned over a respective antenna module 200. The alignment grid 206 is then urged onto the antenna layer 208 so that frame segments 212 are secured onto connection interfaces 214 defined by the antenna modules 200.

Figure 19:
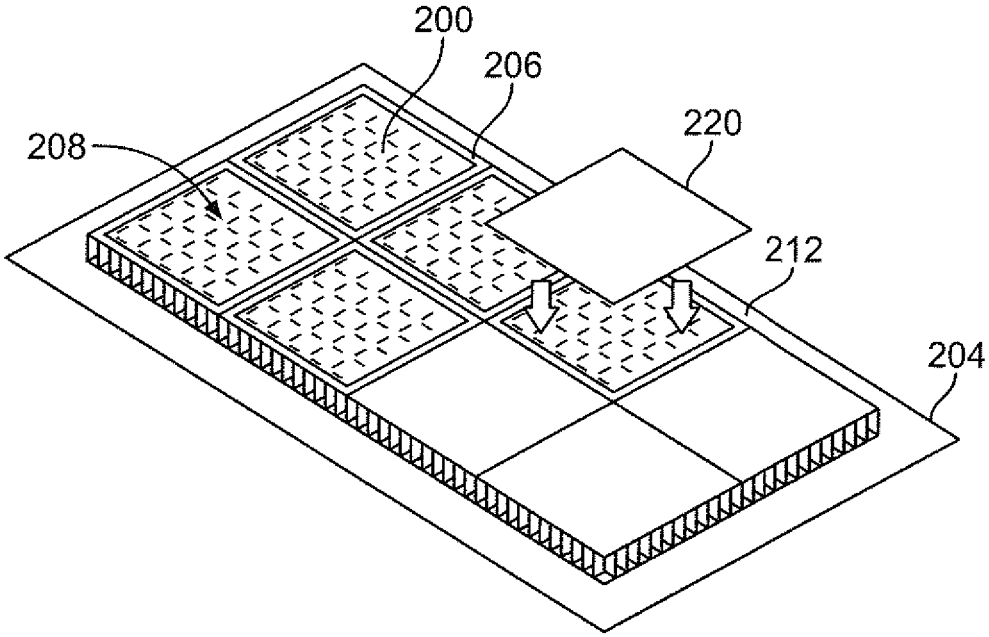
FIG. 19 illustrates a perspective bottom view of electronics card modules being secured to an alignment grid to form an electronics layer, according to an embodiment of the present disclosure.

FIG. 19 illustrates a perspective bottom view of electronics card modules 220 being secured to the alignment grid 206 to form an electronics layer, according to an embodiment of the present disclosure. As shown, each electronics card module 220 is aligned with a respective antenna module 200 and connected thereto. The frame segments 212 of the alignment grid 206 may secure to outer edge connection interfaces of electronics card modules. The electronics card modules 220 are connected together to form the electronics layer.

Figure 20:
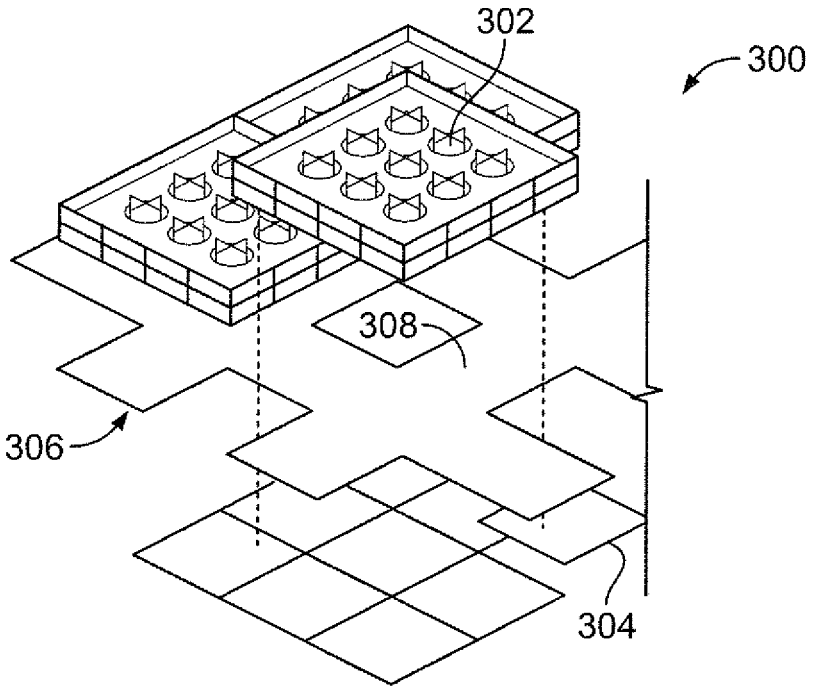
FIG. 20 illustrates a perspective top view of an antenna assembly, according to an embodiment of the present disclosure.

FIG. 20 illustrates a perspective top view of an antenna assembly 300, according to an embodiment of the present disclosure. The antenna assembly 300 includes an antenna layer formed by a plurality of antenna modules 302, and an electronics layer formed by a plurality of electronics card modules 304. An intermediate plate layer 306 formed by a plurality of plates 308 may be used to splice the antenna layer to the electronics layer.

Figure 21:
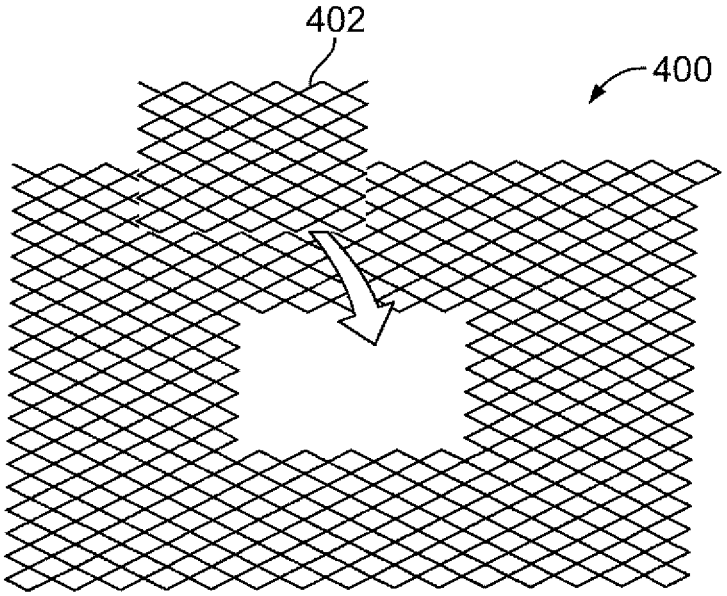
FIG. 21 illustrates a simplified perspective top view of an antenna layer formed by a plurality of antenna modules, according to an embodiment of the present disclosure.

FIG. 21 illustrates a simplified perspective top view of an antenna layer 400 formed by a plurality of antenna modules 402, according to an embodiment of the present disclosure. The antenna modules 402 are similar to the antenna modules described above except that outer walls portions of the antenna modules 402 may be diagonal, angled, serrated, regularly-curved, or the like in order to provide a mechanical interlocking relationship with walls of neighboring antenna modules 402.

Embodiments of the present disclosure provide antenna assemblies and methods for forming the same that include separate and distinct antenna modules that may be connected to one another to form assemblies of varying shapes and sizes. As such, the antenna assemblies are scalable. Further, in comparison to previously-known assemblies, embodiments of the present disclosure may be formed and manufactured at lower cost, time, and labor.

The antenna modules provide fabricated antenna subassemblies that modularly connect to form a single antenna assembly. Each antenna module may be pre-tested before being used to form an antenna assembly.

While various spatial and directional terms, such as top, bottom, lower, mid, lateral, horizontal, vertical, front and the like may be used to describe embodiments of the present disclosure, it is understood that such terms are merely used with respect to the orientations shown in the drawings. The orientations may be inverted, rotated, or otherwise changed, such that an upper portion is a lower portion, and vice versa, horizontal becomes vertical, and the like.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the various embodiments of the disclosure without departing from their scope. While the dimensions and types of materials described herein are intended to define the parameters of the various embodiments of the disclosure, the embodiments are by no means limiting and are exemplary embodiments. Many other embodiments will be apparent to those of skill in the art upon reviewing the above description. The scope of the various embodiments of the disclosure should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, the terms "first," "second," and "third," etc. are used merely as labels, and are not intended to impose numerical requirements on their objects. Further, the limitations of the following claims are not written in means-plus-function format and are not intended to be interpreted based on 35 U.S.C. §112(f), unless and until such claim limitations expressly use the phrase "means for" followed by a statement of function void of further structure.

This written description uses examples to disclose the various embodiments of the disclosure, including the best mode, and also to enable any person skilled in the art to practice the various embodiments of the disclosure, including making and using any devices or systems and performing any incorporated methods. The patentable scope of the various embodiments of the disclosure is defined by the claims, and may include other examples that occur to those skilled in the art. Such other examples are intended to be within the scope of the claims if the examples have structural elements that do not differ from the literal language of the claims, or if the examples include equivalent structural elements with insubstantial differences from the literal languages of the claims.

What is claimed is:

1. An antenna assembly, comprising:

a plurality of separate and distinct antenna modules that are interconnected together to form an antenna layer, wherein portions of neighboring antenna modules abut against one another, wherein each of the plurality of separate and distinct antenna modules comprises half-thickness outer walls that cooperate to form a full thickness outer wall when abutting against another half-thickness wall of another one of the plurality of separate and distinct antenna modules;

wherein the full thickness outer wall is defined as a thickness of internal support walls of two or more of the plurality of separate and distinct antenna modules.

2. The antenna assembly of claim 1, further comprising an alignment grid configured to receive and align each of the plurality of separate and distinct antenna modules.

3. The antenna assembly of claim 1, further comprising a cover layer over the plurality of separate and distinct antenna modules.

4. The antenna assembly of claim 1, further comprising a single, unitary electronics layer operatively connected to the antenna layer, wherein the single unitary electronics layer comprises a plurality of separate and distinct electronics card modules.

5. The antenna assembly of claim 1, wherein each of the plurality of separate and distinct antenna modules comprises a core frame connected to a core support.

6. The antenna assembly of claim 5, wherein the core frame is separate and distinct from the core support.

7. The antenna assembly of claim 5, wherein each of the plurality of separate and distinct antenna modules further comprises a backskin connected to one or both of the core frame and the core support.

8. The antenna assembly of claim 1, wherein each of the plurality of separate and distinct antenna modules comprises an antenna card having a plurality of antenna elements.

9. The antenna assembly of claim 1, wherein each of the plurality of separate and distinct antenna modules is bonded together with adhesive through rotational curing.

10. An antenna assembly, comprising:

a plurality of separate and distinct antenna modules that are interconnected together to form an antenna layer, wherein each of the plurality of separate and distinct antenna modules comprises a support structure including a core frame connected to a core support, a backskin connected to one or both of the core frame and the core support; half-thickness outer walls cooperate to form a full thickness outer wall with another half-thickness walls of another one of the plurality of separate and distinct antenna modules;

an alignment grid configured to receive and align each of the plurality of separate and distinct antenna modules; and a cover layer configured to receive and align each of the plurality of separate and distinct antenna modules;

wherein the full thickness outer wall is defined as a thickness of internal support walls of two or more of the plurality of separate and distinct antenna modules.

11. The antenna assembly of claim 10, further comprising an electronics layer operatively connected to the antenna layer.

12. The antenna assembly of claim 11, wherein the electronics layer comprises a plurality of separate and distinct electronics card modules.

13. The antenna assembly of claim 10, wherein the core frame is separate and distinct from the core support.

14. The antenna assembly of claim 10, wherein each of the plurality of separate and distinct antenna modules further comprises an antenna card supported by the support structure, and wherein the antenna card comprises at least one antenna element.

15. The antenna assembly of claim 10, wherein each of the plurality of separate and distinct antenna modules is bonded together with adhesive through rotational curing.

16. An antenna assembly, comprising:

a plurality of separate and distinct antenna modules that are interconnected together to form an antenna layer, wherein each of the plurality of separate and distinct antenna modules comprises half-thickness outer walls that cooperate to form a full thickness outer wall with another half-thickness walls of another one of the plurality of separate and distinct antenna modules further comprises (a) a support structure including a core frame connected to a separate and distinct core support, (b) a backskin connected to one or both of the core frame and the core support, and (c) an antenna card supported by the support structure, wherein the antenna card comprises at least one antenna element, wherein the support structure, the backskin and the antenna card are bonded together with adhesive through rotational curing;

an alignment grid configured to receive and align each of the plurality of separate and distinct antenna modules;

a cover layer configured to receive and align each of the plurality of separate and distinct antenna modules; and an electronics layer operatively connected to the antenna layer, wherein the electronics layer comprises a plurality of separate and distinct electronics card modules;

wherein the full thickness outer wall is defined as a thickness of internal support walls of two or more of the plurality of separate and distinct antenna modules.

17. The antenna assembly of claim 16, wherein portions of neighboring antenna modules abut against one another.

18. The antenna assembly of claim 16, wherein the support structure, the backskin, and the antenna card are mechanically connected together, covered with a flowing adhesive, and rotated during the rotational curing so that the adhesive flows over and through the connection interfaces and interstices between the support structure, the backskin, and the antenna card.

* * * * *